US006479806B2

(12) United States Patent
Lee et al.

(10) Patent No.: US 6,479,806 B2
(45) Date of Patent: Nov. 12, 2002

(54) MICROWAVE OVEN HAVING OVERHEAT PREVENTING FUNCTION AND METHOD OF CONTROLLING ITS FAN MOTOR

(75) Inventors: Sung-Ho Lee, Suwon (KR); Young-Won Cho, Suwon (KR); Tae-Soo Kim, Seoul (KR)

(73) Assignee: SamSung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/781,313

(22) Filed: Feb. 13, 2001

(65) Prior Publication Data

US 2002/0053565 A1 May 9, 2002

(30) Foreign Application Priority Data

Nov. 8, 2000 (KR) ..... 2000-66146

(51) Int. Cl.[7] ..... H05B 6/68
(52) U.S. Cl. ..... 219/757; 219/702
(58) Field of Search ..... 219/757, 702, 219/715, 716, 718; 126/21 A, 237 A, 299 R, 299 D; 361/694, 695

(56) References Cited

U.S. PATENT DOCUMENTS

| | | | | |
|---|---|---|---|---|
| 4,191,875 A | | 3/1980 | Cunningham | |
| 4,751,451 A | | 6/1988 | Vincent | |
| 6,072,169 A | * | 6/2000 | Kang et al. | 219/702 |
| 6,093,922 A | * | 7/2000 | Kim | 219/757 |
| 6,104,016 A | * | 8/2000 | Lee | 219/702 |

* cited by examiner

*Primary Examiner*—Teresa Walberg
*Assistant Examiner*—Quang T Van
(74) *Attorney, Agent, or Firm*—Robert E. Bushnell, Esq.

(57) ABSTRACT

Disclosed is a microwave oven capable of cooking food according to an output mode in response to an output level of its magnetron, including a fan motor having a low-speed node and a high-speed node to receive power, and having a turning speed variable in response to a node connecting state; an output mode selecting part through which one of output modes is selected; a switching part having at least one switch for switching power applied to the low-speed node or high-speed node of the fan motor; and a control unit controlling the switching part in response to an output mode selected by the output mode selecting part, thus preventing its electrical components from being overheated.

16 Claims, 8 Drawing Sheets

MICROWAVE OVEN HAVING OVERHEAT PREVENTING FUNCTION AND METHOD OF CONTROLLING ITS FAN MOTOR

CLAIM OF PRIORITY

This application makes reference to, incorporates the same herein, and claims all benefits accruing under 35 U.S.C.§§119 from an application for MICROWAVE OVEN HAVING A PREVENTING OVERHEAT AND METHOD FOR OPERATING A FAN MOTOR OF THE MICROWAVE Oven earlier filed in the Korean Industrial Property Office on Nov. 8, 2000 and there duly assigned Ser. No. 66146/2000 by the Office.

BACKGROUND OF THE INVENTION

1. Field of the Invention

The present invention relates to a microwave oven having an overheat preventing function and a method of controlling its fan motor. More specifically, the present invention relates to a microwave oven which controls the turning speed of its fan motor variably in response to an output level of its magnetron, and increases the turning speed of a cooling fan when the magnetrons output is high, thereby preventing its electrical components from being overheated, and further relates to a method of controlling its fan motor.

2. Description of the Related Art

A microwave oven is a cooking appliance that cooks food rapidly by using microwaves, and has a high-voltage transformer and a magnetron. The high-voltage transformer produces given high voltages to drive the magnetron, and this magnetron emits microwaves of high frequencies (about 2,450 MHz) to the inside of its cooking chamber in which food is held. The microwave moves the molecules of the food being cooked at high speeds, and the food is cooked by friction heat generated by the movement of the molecules.

Referring to FIG. 1, this conventional microwave oven includes a main body 20 forming the outer appearance of the oven, a cooking chamber 22 provided to one side of the main body 20 and opened in the front, and an electrical component compartment 23 provided to the other side and housing a lamp 2, a cooling fan 3, a magnetron MGT, a high-voltage transformer HVT, a high-voltage condenser HVC, etc. A control panel 25 having a display and operating buttons is located on the front of the compartment 23. A door 21 is hinged on one side of the front of the main body 20 to open and close the cooking chamber 22. A tray 24 is mounted on the floor of the cooking chamber 22, and food to be cooked is put on this tray 24. The tray 24 is turned by a driving motor and gears (not shown) provided to the bottom of the main body 20 to enhance the cooking efficiency.

Simultaneously with actuating the magnetron MGT to cook the food on the tray 24, the fan motor (not shown) is driven to turn the cooling fan 3. The outside air is introduced to the inside of the compartment 23 by the action of the cooling fan 3 to cool the electrical components on a printed circuit board of the respective magnetron MGT, high-voltage condenser HVC, high-voltage transformer HVT, and control panel 25. The fan motor keeps the constant turning speed without regard to an output level of the magnetron.

There are several methods of controlling the output level of the magnetron for the conventional microwave oven, which is fully described as follows.

The first one is a method of controlling the magnetron MGT's output in response to a voltage applied to the transformer HVT's secondary winding by varying the number of the transformer HVT primary windings turns. In other words, an intermediate tap is provided to the primary winding of the transformer HVT, and power is then applied by turning on a relay connected to this intermediate tap. As a result, the number of the primary winding's turns is decreased, and a voltage higher than normal one is applied to the transformer HVT so that the magnetron MGT's output is high.

The second one is a method of controlling the magnetron MGT's output by varying the number of the transformer HVT secondary winding's turns, instead of keeping the number of the transformer HVT primary winding's turns. In this occasion, as the number of the transformer HVT's secondary winding is increased, the transformer HVT's volume is inevitably increased.

The third one is a method of controlling the magnetron MGT's output by adjusting the ratio of the turned-on time for applying the power and the turned-off time for cutting off the power supply. More specifically, if the turned-on time is reduced and the turned-off time is increased by controlling a power relay, the magnetron's output is low. On the contrary, if the turned-on time is increased and the turned-off time is decreased, the magnetron's output is high.

In case of using the conventional microwave oven in high-output mode by increasing the magnetron's output, the surface temperature of the respective electrical components along with the magnetron in the electrical component compartment is inevitably raised more than in low-output mode. If a user does not take any proper step, the electrical components are overheated and malfunction, thus being reduced in life.

When the magnetron's output is high, the cooling fans turning speed needs to be increased to drop the inside temperature of the electrical component compartment rapidly. However, since the cooling fan used for the conventional microwave oven operates at constant turning speed, it cannot cool the electrical components rapidly in high-output mode. More specifically, the turning speed of the cooling fan depends on the driving speed of the fan motor, and the conventional fan motor is preset to be driven at constant turning speed suitable for normal output mode. Accordingly, the fan motor is driven by the preset number of revolutions without regard to the output level of the magnetron, so it cannot operate satisfactorily in high-output mode.

Considering the above matter, a fan motor that can be driven by the large number of revolutions to meet the high-output mode may be used. However, this motor is not proper one for the low-output mode. Continuously driving the fan motor even in the low-output mode causes the unnecessary power consumption.

Thus, there is a need to develop a technique of driving the fan motor at low speeds if the magnetron's output is low to decrease the power consumption, and driving the fan motor at high speeds if the magnetron's output is high to prevent its electric components from being overheated.

SUMMARY OF THE INVENTION

It is an object of the present invention to provide a microwave oven which controls the turning speed of its fan motor variably in response to an output level of its magnetron and increases the turning speed of a cooling fan when the magnetron's output is high, thereby preventing its electrical components from being overheated, and a method of controlling its fan motor.

In order to achieve the above object, the present invention provides a microwave oven capable of cooking food according to an output mode in response to an output level of its magnetron, including a fan motor having a low-speed node and a high-speed node to receive power, and having a turning speed variable in response to a node connecting state; an output mode selecting part through which one of output modes is selected; a switching part having at least one switch for switching power applied to the low-speed node or high-speed node of the fan motor; and a control unit controlling the switching part in response to an output mode selected by the output mode selecting part.

According to another aspect of the present invention, a microwave oven capable of cooking food according to an output mode in response to an output level of its magnetron, includes a fan motor having a plurality of nodes as a power input terminal, and having a turning speed variable upon receipt of a power through the nodes; an output mode selecting part through which one of plural output modes is selected; a switching part for switching the power applied to the fan motor's input terminal; and a control unit controlling the switching part in order to set up the fan motor's turning speed in response to an output level of the magnetron corresponding to an output mode selected by the output mode selecting part .

According to still another aspect of the present invention, a method of controlling a fan motor for a microwave oven capable of cooking food according to an output mode in response to an output level of its magnetron, includes the steps of (a) determining if an output mode is selected; (b) if a low-output mode is selected in the step (a), performing a cooking according to the low-output mode by applying a power to the fan motor's low-speed node; and (c) if a high-output mode is selected in the step (a), performing a cooking according to a high-output mode by applying the power to the fan motor's high-speed node.

The step of performing the cooking according to the high-output mode includes the substeps of (d) driving the magnetron in a high-output level; (e) driving the fan motor at high speeds by applying the power to the fan motor's high-speed node; (f) checking if the high-output mode is completed; and (g) if the high-output mode is completed in the step (f), stopping the magnetron's operation.

According to still another aspect of the present invention, a method of controlling a fan motor for a microwave oven capable of cooking food according to an output mode in response to an output level of its magnetron, includes the steps of selecting a user-desired output mode through a key input part; driving the magnetron according to an output level corresponding to the selected output mode; and switching a power applied to the fan motor's input terminal so as to increase the fan motor's turning speed as the magnetron's output level is increased.

According to still another aspect of the present invention, a method of controlling a fan motor for a microwave oven capable of cooking food according to an output mode in response to an output level of its magnetron, includes the steps of (1) selecting desired one of plural output modes; (2) if a low-output mode is selected in the step (1), performing a cooking according to the low-output mode by applying a power to a low-speed node of the fan motor's plural input terminals; (3) if a high-output mode is selected in the step (1), performing a cooking according to the high-output mode by applying the power to a high-speed node of the fan motor's plural input terminals; and (4) after cooking food according to the low-output mode or high-output mode has been completed, performing a deodorization mode to remove the smell produced by cooking the food to the outside.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 1:
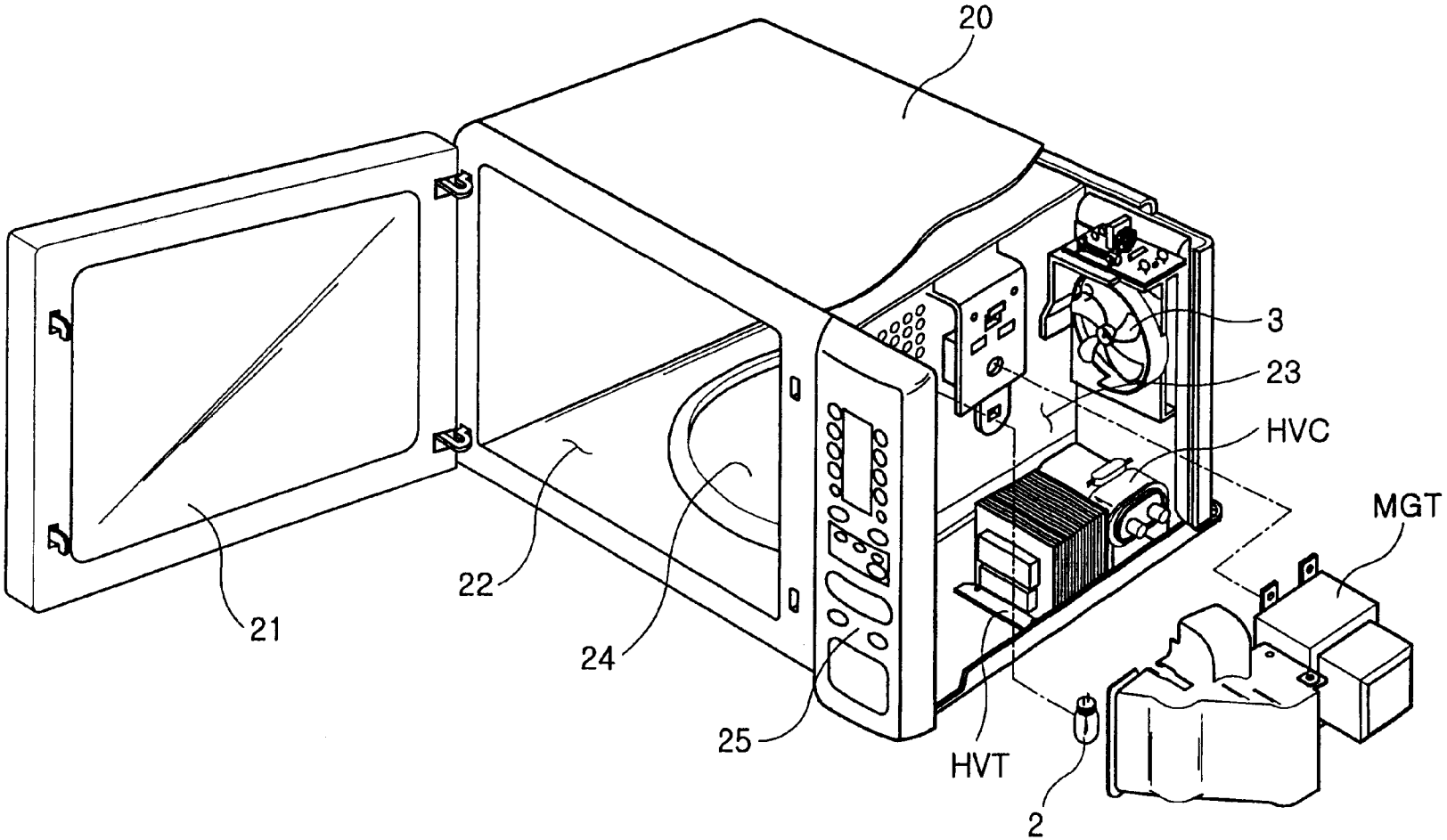
FIG. 1 (PRIOR ART)
FIG. 1 is a cut-away perspective view of a conventional microwave oven.

The microwave oven of the present invention partially has the same components as the conventional one's (FIG. 1), and like reference numerals denote like reference parts throughout the specification and drawings.

Figure 2:
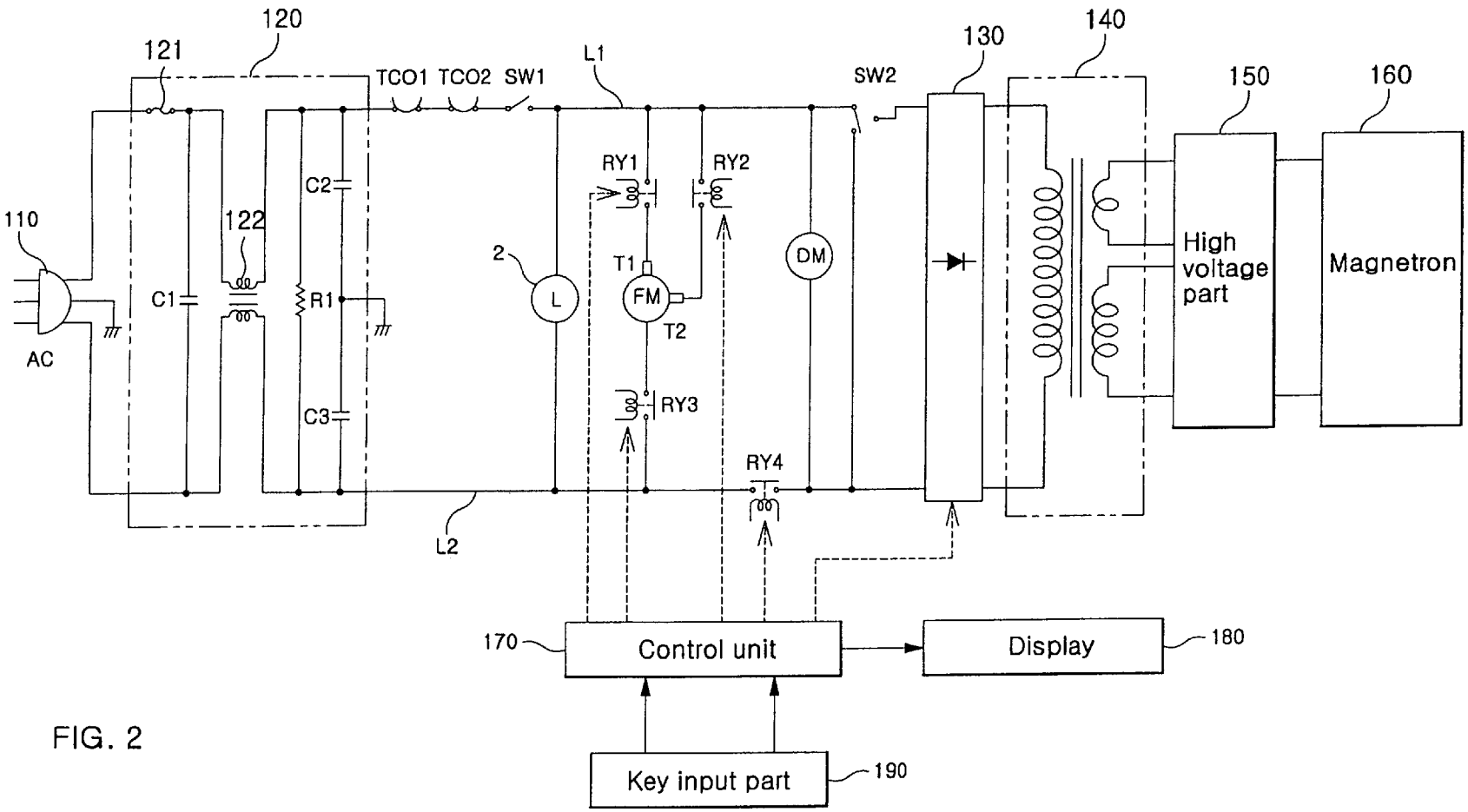
FIG. 2 is a block-circuit diagram of a microwave oven having an overheat preventing function in accordance with a first preferred embodiment of the present invention.

FIG. 2 is a block-circuit diagram of a microwave oven having an overheat preventing function in accordance with a first preferred embodiment of the present invention.

As depicted in FIG. 2, the microwave oven of the present invention includes a high-voltage transformer (HVT) 140, a high-voltage part 150 and a magnetron (MGT) 160 producing high frequency energy used for cooking food, a key input part 190 through which a command to cook is input by a user, a display 180 showing the operating state of the microwave oven, and a control unit 170 controlling the overall operation of the microwave oven.

The inventive microwave oven has a plug 110 and a noise filter 120 through which common alternating-current (AC) power is applied thereto. The noise filter 120 consists of a fuse 121, condensers C1 to C3, an inductor 122, a resistor R1, etc.

A first temperature sensor TCO1 turned on/off in response to the temperature of a cooking chamber, a second temperature sensor TCO2 turned on/off in response to the magnetron MGT's temperature, and a door switch SW1 turned on/off by opening/closing a door 21 are connected to one end of the noise filter 120.

The door switch SW1 is connected to a lamp (L) 2, and this lamp (L) is automatically turned on if the door 21 is closed to turn on the door switch SW1, thus lighting the cooking chamber.

A fan motor FM is coupled in parallel to common AC lines L1 and L2 (first and second power lines) each connected to both terminals of the lamp L. A power relay RY4 is coupled in series to the second power line L2, and the power relay RY4 applies power if the control unit 170 turns on the relay RY4. A driving motor DM for rotating a tray is connected to both terminals of the first and second power lines L1 and L2. The power relay RY4 is turned on to turn the tray. A monitor switch SW2 turned on/off by opening/closing the door 21 is connected to the first power line L1, and acts with the door switch SW1.

If the power relay RY4 is turned on to apply power, an inverter part 130 controls switching devices under the control of the control unit 170 to apply power to the high-voltage transformer 140's primary winding. If the inverter part 130 receives a control signal indicative of high output mode from the control unit 170, it reduces the switching period of the switching devices to increase voltages applied to the high-voltage transformer 140's secondary winding. If the inverter part 130 receives a control signal indicative of low output mode from the control unit 170, it increases the switching period of the switching devices to lower voltages applied to the high-voltage transformer 140's secondary winding.

The fan motor FM of the present invention has a low-speed node T1 and a high-speed node T2. A first relay RY1 that is turned on by the control unit 170 is coupled in series between the low-speed node T1 and the first power line L1, and a second relay RY2 that is turned on by the control unit 170 is connected in series between the high-speed node T2 and the first power line L1. A main relay RY3 that is turned on by the control unit 170 is coupled in series between the fan motor FM and the second power line L2. The main relay RY3 is provided to control the application of power to the fan motor FM.

If the first relay RY1 and the main relay RY3 are turned on, the fan motor FM receiving power by way of the low-speed node T1 is driven at low speeds, and a cooling fan 3 installed in an electrical component compartment 23 is then turned at low speeds. When the second relay RY2 and the main relay RY3 are each turned on, the fan motor FM receiving power through the high-speed node T2 is driven at high speeds, thus turning the cooling fan 3 at high speeds.

Once the action of the magnetron 160 stops as the cooking is completed, the fan motor FM can be driven in order to remove the smell from the interior of the cooking chamber. Such a deodorization mode can be automatically carried out either by the control unit 170 after the cooking has been completed or by a user's inputting a command to deodorize through the key input part 190. The control unit 170 turns on the first relay RY1 or the second relay RY2 when the cooking is completed or in response to the command applied from the key input part 190, thus driving the fan motor FM at low speeds or at high speeds.

Figure 3A:
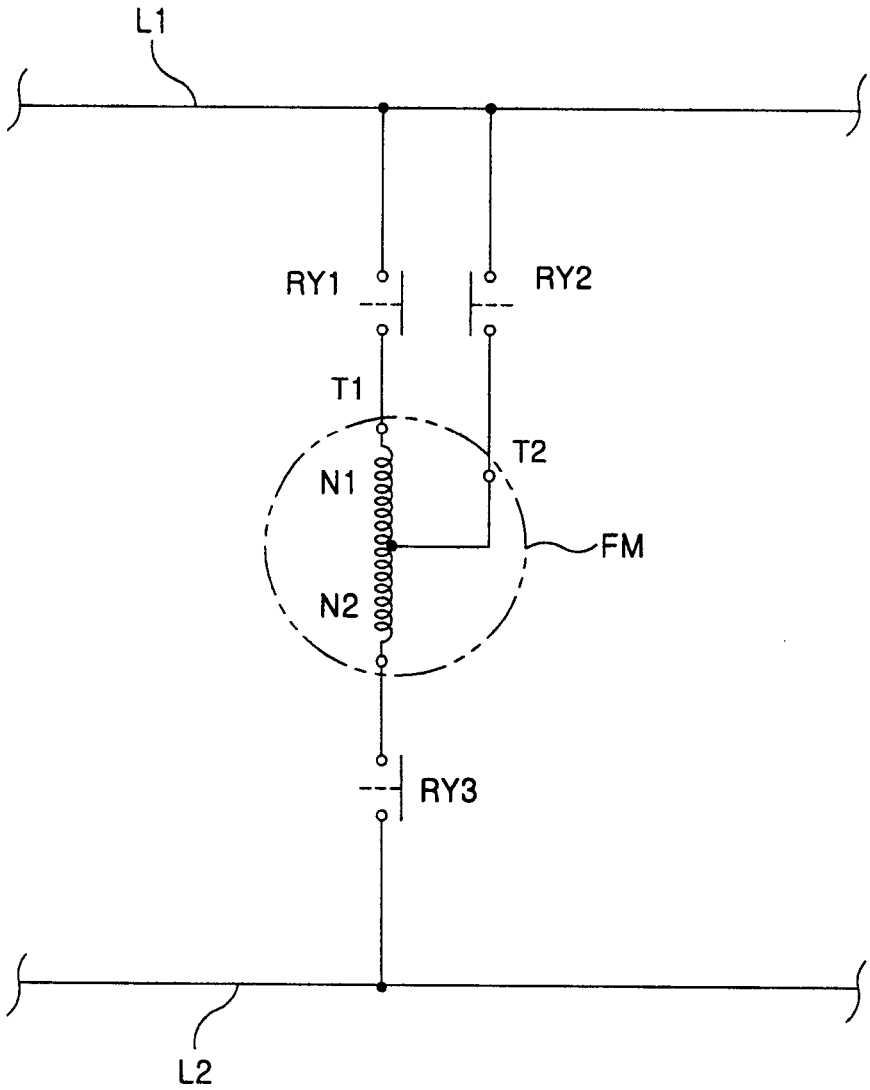
FIGS. 3*a* and 3*b* each depict the connecting state of a fan motor's driving winding in accordance with the present invention.
Figure 3B:
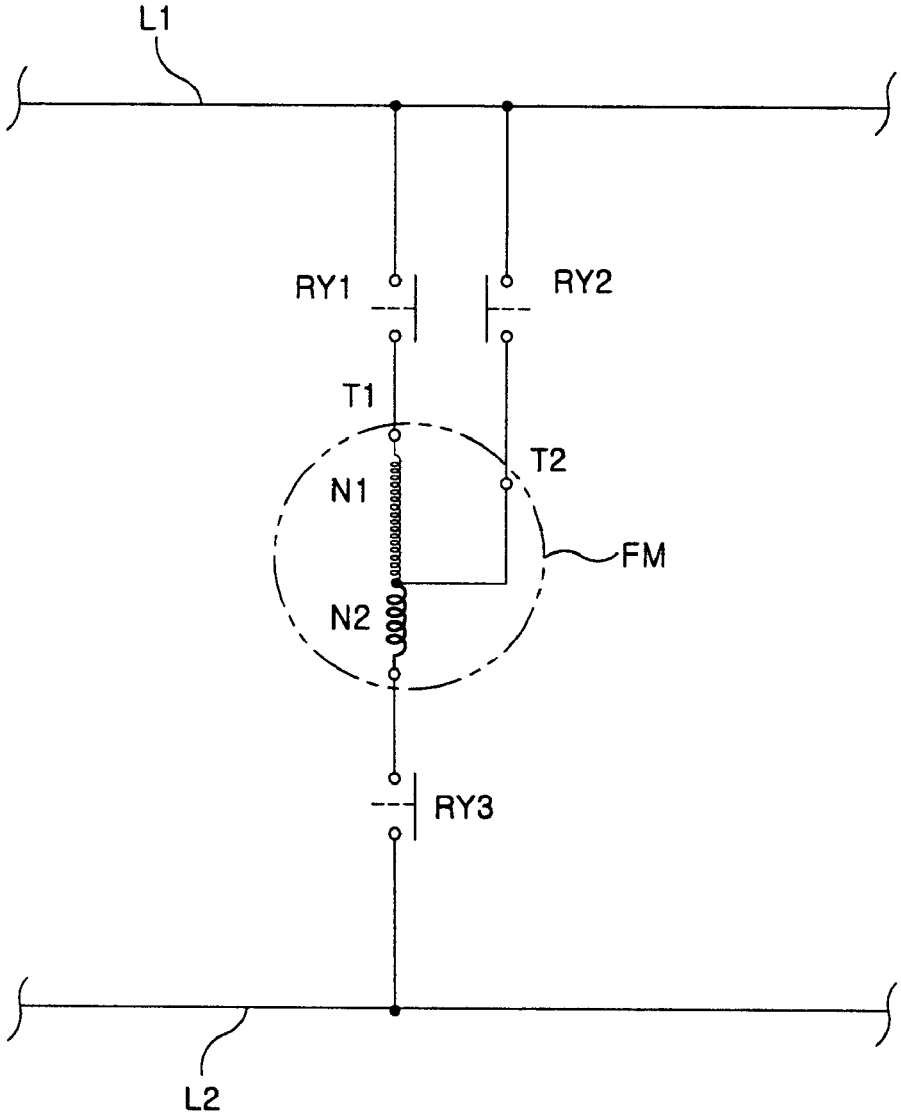

The operation of the fan motor FM is now described referring to FIGS. 3a and 3b. The speed of the fan motor FM depends on the amount of the driving electric current flowing across the fan motor FM's driving windings N1 and N2. For example, when the control unit 170 turns on the first relay RY1 and the main relay RY3 and turns off the second relay RY2 in order to cook food in low-output mode, the power is applied through the low-speed node T1 to actuate the motor. At this point, since the driving electric current flows across the primary driving winding N1 and the secondary driving winding N2, it turns the cooling fan 3 at low speeds (e.g. about 1800rpm).

In order to cook food in high-output mode, when the control unit 170 turns off the first relay RY1 and turns on the second relay RY2 and the main relay RY3, the power is applied by way of the high-speed node T2 to actuate the motor. Since the driving electric current flows across the secondary driving winding N2, the control unit 170 turns the cooling fan 3 at high speeds (e.g. about 3000 rpm).

The number of the primary driving winding N1's turns and the number of the secondary driving winding N2's turns can be set considering the turning speed of the motor in each of low- and high-output modes. When the speed in high-output mode is higher than that in low-output mode, the number of the secondary driving winding N2s turns should be smaller than that of the primary driving winding N1's.

When providing the primary driving winding N1 and the secondary driving winding N2 to each core, it is preferable, as shown in FIG. 3B, that the primary driving winding N1 forms a coil with a small diameter and the large number of turns, and the secondary driving winding N2 forms a coil with a large diameter and the small number of turns, thus reducing the size of the motor and rapidly making the motor operate at a given turning speed in response to high-output mode or low-output mode.

Figure 4:
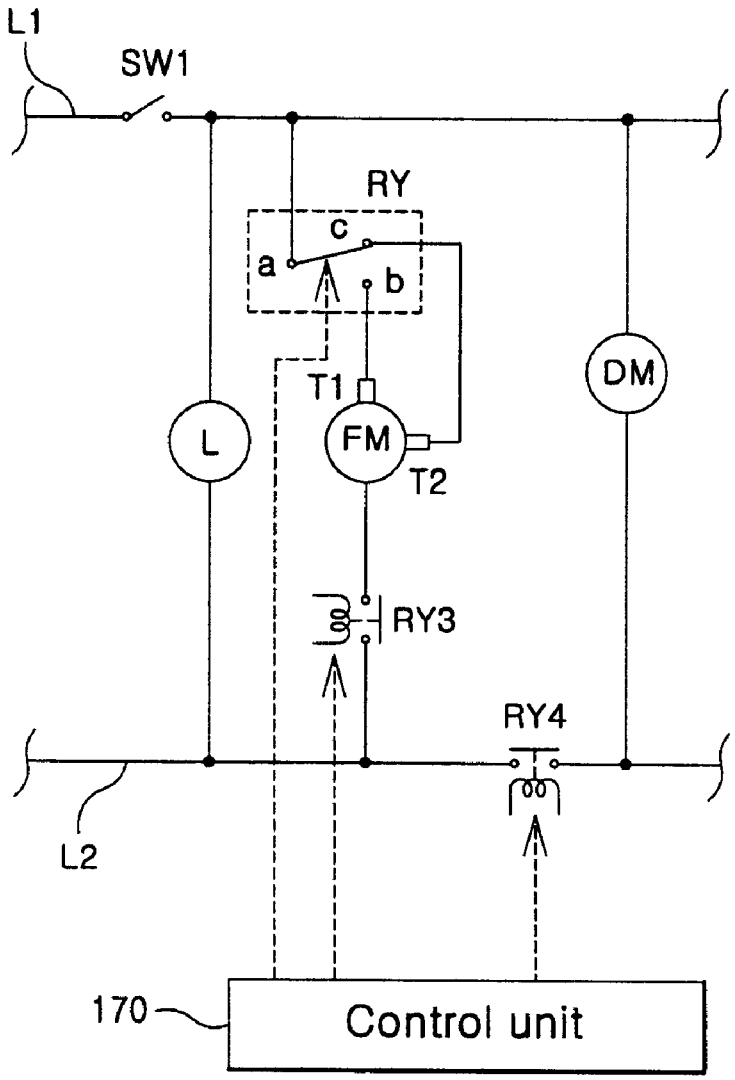
FIG. 4 is a circuit diagram of a microwave oven having an overheat-preventing function in accordance with a second preferred embodiment of the present invention.

FIG. 4 is a circuit diagram of a microwave oven having an overheat- preventing function in accordance with a second preferred embodiment of the present invention. The description about the same reference parts having the same functions is omitted. In this embodiment of FIG. 4, a single relay RY is used whereas two relays RY1 and RY2 are used for low-speed driving and high-speed driving in the first preferred embodiment of FIG. 2. Referring to FIG. 4, the power is applied to the fan motor FM via the single relay RY by the control unit 170.

The relay RY is selectively connected to any one of the low-speed node T1 or the high-speed node T2. The relay RY's fixed terminal a is switched on by the control unit 170 in low-output mode, and connected to a first movable terminal b, and applies the power to the low-speed node T1. The relay RY's fixed terminal a is switched by the control unit 170 in high-output mode and connected to a second moving terminal c, and applies the power to the high-speed node T2.

Since the relay RY is connected to any one of the low-speed node T1 or the high-speed node T2, if driving the fan motor FM is not required, the main relay RY3 connected to the fan motor FM and the second power line L2 should be turned off.

Figure 5:
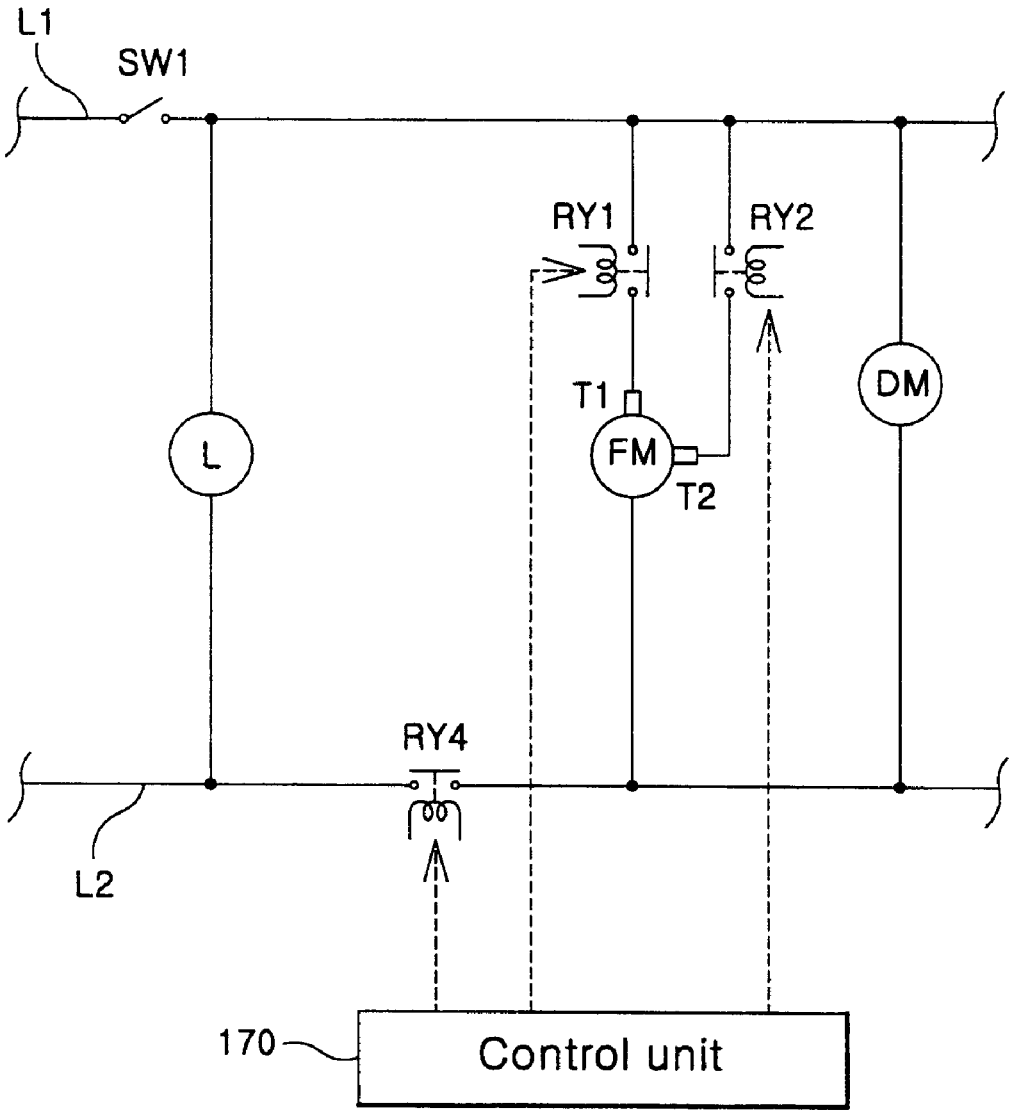
FIG. 5 is a circuit diagram of a microwave oven having an overheat-preventing function in accordance with a third preferred embodiment of the present invention.

FIG. 5 is a circuit diagram of a microwave oven having an overheat- preventing function in accordance with a third preferred embodiment of the present invention. A power relay is used instead of the main relay RY3 of FIG. 2.

Referring to FIG. 5, the main relay RY3 for controlling the application of power to the fan motor FM is removed, and the power relay RY4 is connected to the second power line L2 in front of the fan motor FM. When turning off the power relay RY4, the power is not applied to the fan motor FM. In this occasion, the fan motor FM can be driven at low or high speeds by turning on the first relay RY1 or second relay RY2 while the power relay RY4 is being turned on.

Figure 6A:
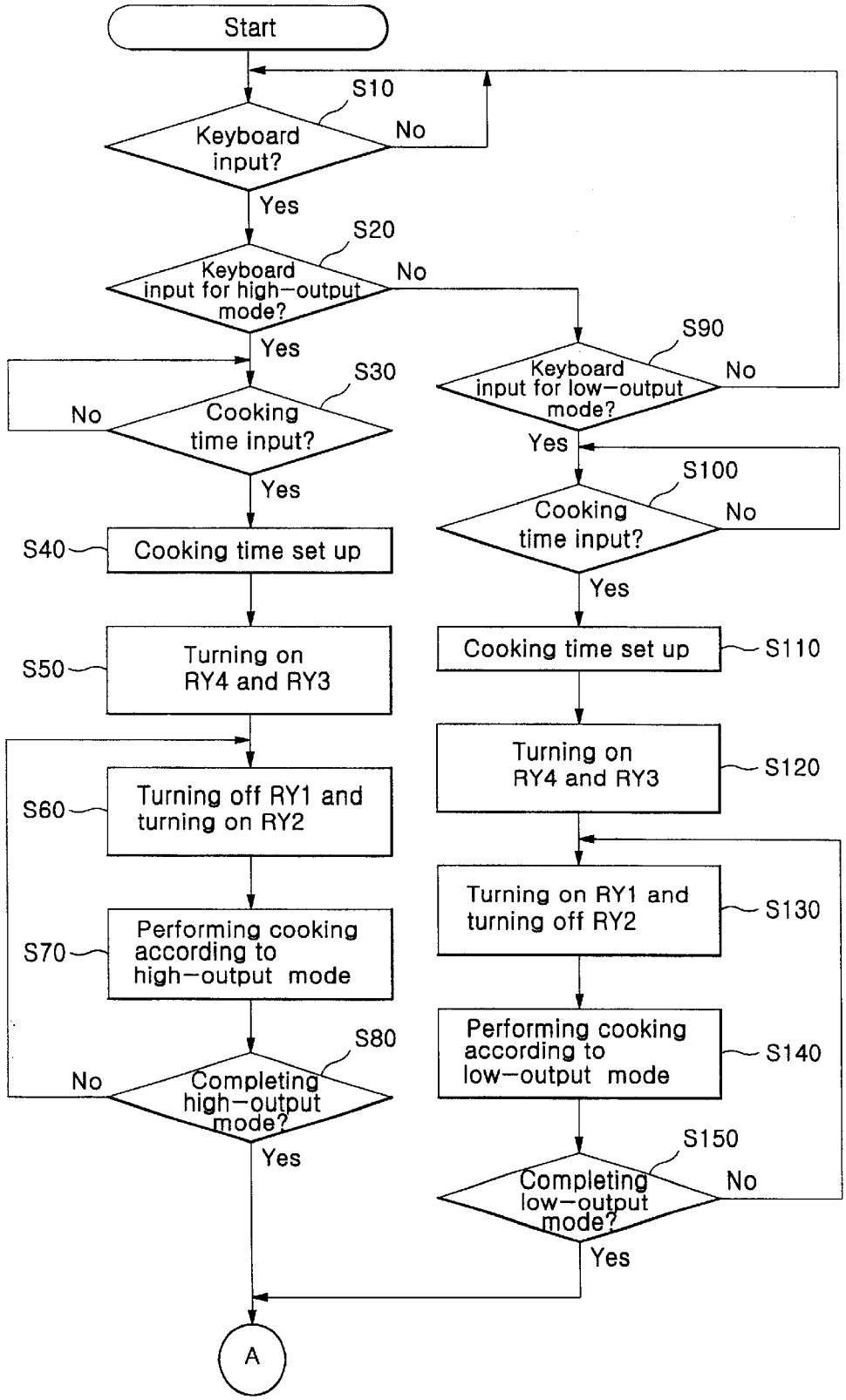
FIGS. 6*a* and 6*b* each depict the control sequence of the inventive microwave oven's fan motor.
Figure 6B:
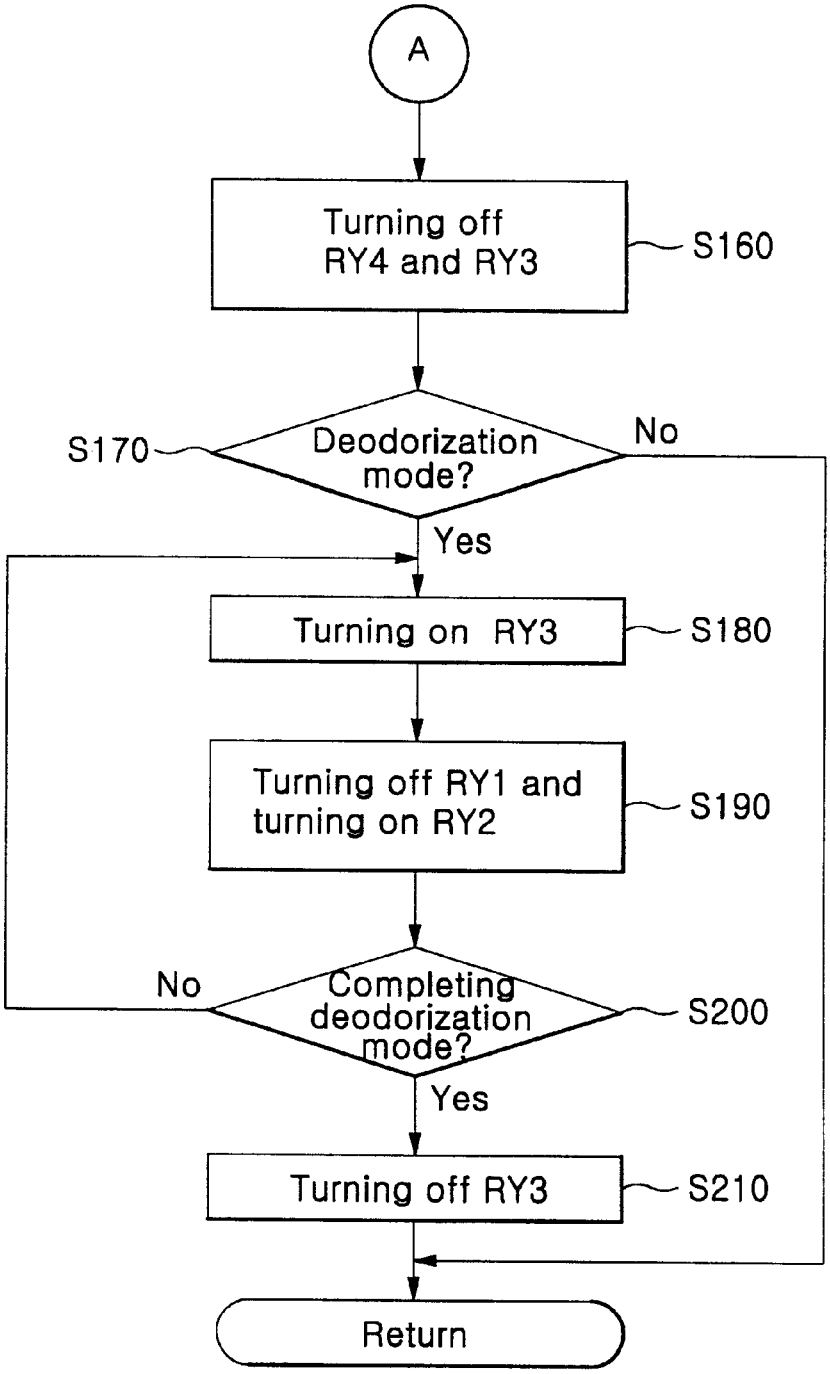

A method of controlling the fan motor for the inventive microwave oven is now fully described referring to FIGS. 2, 6*a* and 6*b*.

Referring first to FIG. 6*a*, the control unit 170 determines (S10) if a keyboard input is applied from the-key input part 190. If the keyboard input is applied, the control unit 170 determines (S20) whether or not the keyboard input is a signal for setting a high-output mode. When the control unit 170 determines that the keyboard input for high-output mode is applied, it monitors (S30) whether or not a period of time for cooking food is applied through the key input part 190 by a user.

If the control unit 170 determines that the period of time for cooking food is applied, it sets up the period of time for cooking in its internal memory as the time for cooking and stores it therein (S40). The control unit 170 turns on (S50) the power relay RY4 and the main relay RY3 in order to apply power to the fan motor FM.

The control unit 170 turns off (S60) the first relay RY1 connected to the low-speed node T1 and turns on the second relay RY2 connected to the high-speed node T2 in order to drive the fan motor FM at high speeds in response to the keyboard input for high-output mode.

Accordingly, the power is applied to the high-speed node T2 of the fan motor FM to driven the fan motor FM and the cooling fan 3 of the electrical component compartment 23 at high speeds (e.g. about 3000 rpm), as well.

The control unit 170 reduces the turned-on period of the inverter part 130's internal switching device, and applies the high voltage to the high-voltage transformer 140's secondary winding, thus cooking food in high-output mode (S70).

The control unit 170 determines (S80) if the period of time for cooking food preset in the step S40 elapses and the cooking in high-output mode is completed. If the time does not elapse and the cooking in high-output mode is not completed in the step S80, the control part 170 returns to the step S60 to continue cooking. If the time does elapse and the cooking in high-output mode is completed in the step S80, the control unit 170 goes to the step S160. If the control unit 170 determines that there is no keyboard input for high-output mode in the step S20, it determines (S90) if a keyboard input for setting low-output mode exists. If the control unit 170 determines that there is no keyboard input for low-output mode in the step S90, it interprets it as an erroneous state where an output mode is not selected, and returns to the step S10.

If the control unit 170 determines that there is a keyboard input for low-output mode in the step S90, it monitors (S100) whether or not a user inputs a period of time for cooking through the key input part 190. When the control unit 170 determines that he or she inputs the period of time in the step S100, it sets up the period of time in the internal memory as the time for cooking, and stores it therein (S100).

The control unit 170 turns on the power relay RY4 and turns on the main relay RY3 to apply the power to the fan motor FM in the step S120. The control unit 170 turns on the first relay RY1 connected to the low-speed node T1 and turns off the second relay RY2 connected to the high-speed node T2 in order to drive the fan motor FM at low speeds (S130). As the power is applied to the low-speed node T1 of the fan motor FM, the fan motor FM is driven at low speeds, and the cooling fan 3 installed in the electrical component compartment 23 is turned at low speeds (e.g. about 1800 rpm) in response thereto. The control unit 170 increases the turned-on period of the inverter part 130's switching device, and applies low voltages to the high-voltage transformer's secondary winding to make a low-output mode, thus performing the cooking operation (S140).

The control unit 170 determines (S150) if the period of time for cooking food preset in the step S110 elapses and the cooking in low-output mode is completed. If the time does not elapse and the cooking in low-output mode is not completed in the step S150, the control part 170 returns to the step S130 to continue cooking. If the time does elapse and the cooking in high-output mode is completed in the step S150, the control unit 170 goes to the step S160.

The control unit 170 turns off the power relay RY4 to complete the cooking in high- or low-output mode, and turns off the main relay RY3 to cut off the application of power to the fan motor FM in the step S160.

After completing the step S160, the control unit 170 determines (S170) if the deodorization mode is set up. The deodorization mode can be performed by a user's inputting a command to deodorize through the key input part 190, or may be previously programmed to be automatically carried out after the cooking has been completed according to a user-selected cooking mode (high-output mode or low-output mode).

If the deodorization mode is set up in the step S170, the control unit 170 turns on (S180) the main relay RY3. At this point, the power relay RY4 is being turned off. The control unit 170 turns off the first relay RY1 and turns on the second relay RY2, thus driving the fan motor FM at high speeds so that the smell in the cooking chamber can be rapidly removed (S190).

The control unit 170 determines (S200) if a period of time, previously set up, elapses and the deodorization mode is completed. If the deodorization mode is not completed, the control unit 170 returns to the step S180 in order to continue the deodorization process. If the period of time elapses and the deodorization mode is completed, the control unit 170 turns off (S210) the main relay RY3 to stop the deodorization process, and then completes the control program.

In the above-preferred embodiments of the present invention, the fan motor with two nodes (high-speed and low-speed nodes) has been described, and a fan motor receiving power by way of a plurality of nodes can be similarly employed in the present invention. As the magnetron's output level is high, the control unit switches the power applied to the fan motor's input terminal in order to increase the fan motor's speed, thereby efficiently preventing the electrical components from being overheated.

According to this invention, when increasing the magnetron's output to cook food, the fan motor is driven at high speeds and the cooling fan is also turned at high speeds, so the cooling performance of the cooling fan with respect to the electrical components is not degraded compared to the normal output mode. Therefore, the present invention can prevent the electrical components from being overheated in high-output mode, and the smell in the cooking chamber can be rapidly removed to the outside by driving the fan motor at high speeds in the deodorization mode.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A microwave oven capable of cooking food according to an output mode in response to an output level of its magnetron, comprising:

a fan motor having a low-speed node and a high-speed node to receive power, and having a turning speed variable in response to a node connecting state, said fan motor driving a cooling fan for cooling electrical components within a compartment of said microwave oven;

an output mode selecting part through which any one of several output modes is selected;

switching means having at least one switch for switching power applied to the low-speed node or high-speed node of the fan motor; and control means controlling the switching means in response to an output mode selected by the output mode selecting part.

2. A microwave oven according to claim 1, wherein the switching means has first and A second relays each connected to a power line, and the first relay and the second relay are connected to the low-speed node and the high-speed node, respectively.

3. A microwave oven according to claim 1, wherein the switching means has a relay connected to a power line, and the relay is selectively connected to the low-speed node or high-speed node.

4. A microwave oven according to claim 1, wherein the fan motor has a primary driving winding forming a first coil and a secondary driving winding forming a second coil, and the high-speed node is connected between the primary driving winding and the secondary driving winding.

5. A microwave oven according to claim 4, wherein the first coil has a larger number of turns than the number of turns of said second coil, and said first coil has a diameter smaller than the diameter of said second coil.

6. A microwave oven according to claim 1, further comprising a switch for driving the fan motor if the magnetron stops operating.

7. A microwave oven according to claim 6, wherein the switch has a main relay connected between the power line and the fan motor, and the main relay is turned on in response to a control signal from the control means.

8. A microwave oven capable of cooking food according to an output mode in response to an output level of its magnetron, comprising:

a fan motor having a plurality of nodes as a power input terminal, and having a turning speed variable upon receipt of a power through said nodes, said fan motor driving a cooling fan for cooling electrical components within a compartment of said microwave oven;

an output mode selecting part through which one of plural output modes is selected;

switching means for switching the power applied to the fan motor's input terminal; and control means controlling the switching means in order to set up the fan motor's turning speed in response to an output level of the magnetron corresponding to an output mode selected by the output mode selecting part.

9. A microwave oven according to claim 8, wherein the control means increases the fan motor's turning speed as the magnetron's output level is raised.

10. A method of controlling a fan motor for a microwave oven capable of cooking food according to an output mode in response to an output level of its magnetron, comprising the steps of:

(a) determining if an output mode is selected;

(b) if a low-output mode is selected in the step (a), performing a cooking according to the low-output mode by applying a power to the fan motor's low-speed node; and (c) if a high-output mode is selected in the step (a), performing a cooking according to a high-output mode by applying the power to the fan motor's high-speed node.

11. A method according to claim 10, wherein the step of performing the cooking according to the high-output mode includes the sub-steps of:

(d) driving the magnetron in a high-output level;

(e) driving the fan motor at high speeds by applying the power to the fan motor's high-speed node;

(f) checking if the high-output mode is completed; and (g) if the high-output mode is completed in the step (f), stopping the magnetron's operation.

12. A method according to claim 10, further comprising the steps of:

(h) determining if a deodorization mode is set up after the step (b) or (c) has been performed;

(i) turning on a main relay if the deodorization mode is set up in the step (h);

(j) driving the fan motor by applying the power to the fan motor's low-speed node or high-speed node;

(k) determining if the deodorization mode is completed; and (1) if the deodorization mode is completed in the step (k), turning off the main relay.

13. A method of controlling a fan motor for a microwave oven capable of cooking food according to an output mode in response to an output level of its magnetron, comprising the steps of:

selecting a user-desired output mode through a key input part;

driving the magnetron according to an output level corresponding to the selected output mode; and switching a power applied to the fan motor's input terminal so as to increase the fan motor's turning speed as the magnetron's output level is increased.

14. A method according to claim 13, further comprising the steps of:

setting up a deodorization mode after cooking food has been completed in the desired output level;

if the deodorization mode is set up, driving the fan motor at a desired turning speed by applying the power to a desired input terminal of the fan motor having a plurality of input terminals; and if the deodorization mode is completed, stopping the fan motor's operation.

15. A method of controlling a fan motor for a microwave oven capable of cooking food according to an output mode in response to an output level of its magnetron, comprising the steps of:

(1) selecting desired one of plural output modes;

(2) if a low-output mode is selected in the step (1), performing a cooking according to the low-output mode by applying a power to a low-speed node of the fan motor's plural input terminals;

(3) if a high-output mode is selected in the step (I), performing a cooking according to the high-output mode by applying the power to a high-speed node of the fan motor's plural input terminals; and (4) after cooking food according to the low-output mode or high-output mode has been completed, performing a deodorization mode to remove the smell produced by cooking the food to the outside.

16. A method according to claim 15, wherein the deodorization mode is performed by applying the power to one of the fan motor's plural input terminals, corresponding to a desired deodorization speed.

* * * * *